United States Patent [19]

Szymski

[11] Patent Number: 4,673,177

[45] Date of Patent: Jun. 16, 1987

[54] RESISTANCE FREEWHEEL MECHANISM

[75] Inventor: Eugene J. Szymski, Skokie, Ill.

[73] Assignee: Excelsior Fitness Equipment Co., Northbrook, Ill.

[21] Appl. No.: 796,980

[22] Filed: Nov. 12, 1985

[51] Int. Cl.[4] ..... A63B 21/00

[52] U.S. Cl. ..... 272/73

[58] Field of Search ..... 272/73; 192/48.3, 48.6; 74/572

[56] References Cited

U.S. PATENT DOCUMENTS

| | | | |
|---|---|---|---|
| 2,446,363 | 8/1948 | Danm | 192/48.6 |
| 3,623,582 | 11/1971 | Giger | 192/46 |
| 4,220,232 | 9/1980 | Fey et al. | 192/48.3 |
| 4,286,701 | 9/1981 | MacDonald | 192/48.3 |
| 4,533,136 | 8/1985 | Smith et al. | 272/73 |

*Primary Examiner*—Richard J. Apley
*Assistant Examiner*—S. R. Crow
*Attorney, Agent, or Firm*—McCaleb, Lucas & Brugman

[57] ABSTRACT

A resistance freewheel mechanism useful with bicycle type exercisers in which a crank operated drive shaft is positively interlocked with an inertially weighted flywheel by a first positive acting clutch system for rotatably driving the flywheel in one direction and is selectively releasable from the wheel to permit full or partial freewheeling of the latter upon the application of sufficient torsional resistance to release the first clutch system and fully or partially disengage a second clutch system which frictionally couples the drive shaft to the flywheel.

9 Claims, 5 Drawing Figures

RESISTANCE FREEWHEEL MECHANISM

This invention relates generally to freewheeling devices and more particularly to an improved resistance freewheel mechanism especially useful with crank operated ergometric exercisers employing an inertia flywheel.

Although the resistance freewheel mechanism of this invention is hereinafter described in association with its application to an ergometric exerciser employing a heavy or inertially weighted flywheel rotatable about a vertical axis, its general usefulness as a resistance freewheel mechanism is not so limited. In the application of this invention to an ergometric exerciser however, positive drive is required to rotate the inertia wheel in order to overcome regulated retardation torque applied by brake means used to provide resistance against which the user/operator works. The inertia wheel provides means for continued wheel to crank to leg movements during those periods when the crank is in top dead center or bottom dead center positions and whereat the operators legs are somewhat weaker in providing rotary motion to the activating crank arms. The flywheel affords smooth and steady operation of the exerciser. In the usual flywheel exerciser employing such a direct drive relationship, it is necessary for the user/operator to gradually decrease his cranking rate in order to slow down the inertia wheel. He cannot suddenly stop pedaling inasmuch as the inertia flywheel continues to drive the crank arms. Consequently, it is desirable to have a freewheeling mechanism for an exerciser of the inertia flywheel type which provides means for selectively disengaging the flywheel from the drive means.

Of similar importance is the desirability of providing pedal assist to the user/operator's legs when cranking at a speed slower than that necessary to positively drive the flywheel and of providing for a gradual reengagement and lock up between the pedal actuated drive shaft and the freewheeling flywheel in order to avoid abrupt impact when reengaging the moving flywheel.

SUMMARY OF THE INVENTION

The present invention is directed to a resistance freewheel mechanism useful with ergometric exercisers employing inertia flywheels. This invention conveniently permits the user of such an exercising device to stop or decrease pedaling activity to permit the inertia flywheel to freewheel, while allowing the operator to gradually reengage the drive shaft and flywheel with a smooth transition and interlock between drive shaft and flywheel.

In brief, the freewheeling activity afforded by the present invention is accomplished by first positive acting clutch means between a rotatable crank actuated drive shaft and an inertia flywheel and which is operable to effect positive driving rotation of the flywheel in one direction of rotation; the same releasing the flywheel for freewheeling by halting or slowing the cranking activity of the driving crank arms and drive shaft to bring about relative rotation between the crank shaft and flywheel productive of a torque differential therebetween. Providing such torque differential is of sufficient magnitude to disengage a second gravity or spring actuated friction clutch means intercoupling the drive shaft and freewheel, the latter is released for freewheeling rotation.

It is a primary object of this invention to provide an improved resistance freewheel mechanism for use with ergometric exercisers employing inertially weighted flywheels.

Another important object of this invention is to provide an improved resistance freewheel mechanism as aforesaid which employs a plurality of clutch means disengagably interlocking a drive shaft with a flywheel.

A still further object of this invention is to provide an improved resistance freewheel drive means by which a crank operated drive shaft is positively coupled to the hub of a weighted flywheel for rotatably driving the latter in one direction and which permits full or partial freewheeling activity of the flywheel in response to the application of reverse torque to the drive shaft sufficient to partially or fully disengage a friction clutch connection between the drive shaft and the flywheel.

Still another object of this invention is to provide an improved resistance freewheel mechanism for use with ergometric exercisers employing inertially weighted flywheels in which the user/operator is confronted with a predetermined resistance to assist pedaling activity even though the flywheel is disengaged or released for freewheeling movement.

The above and further objects, features and advantages of this invention will appear to those familiar with the art from the following detailed description of a preferred embodiment thereof, illustrated in the drawings and representing the best mode presently contemplated for enabling those with skill in the art to make and practice this invention.

BRIEF DESCRIPTION OF THE DRAWINGS

The accompanying drawings illustrate the best mode presently contemplated by the inventor for carrying out the invention wherein.

DESCRIPTION OF THE PREFERRED EMBODIMENT

Figure 1:
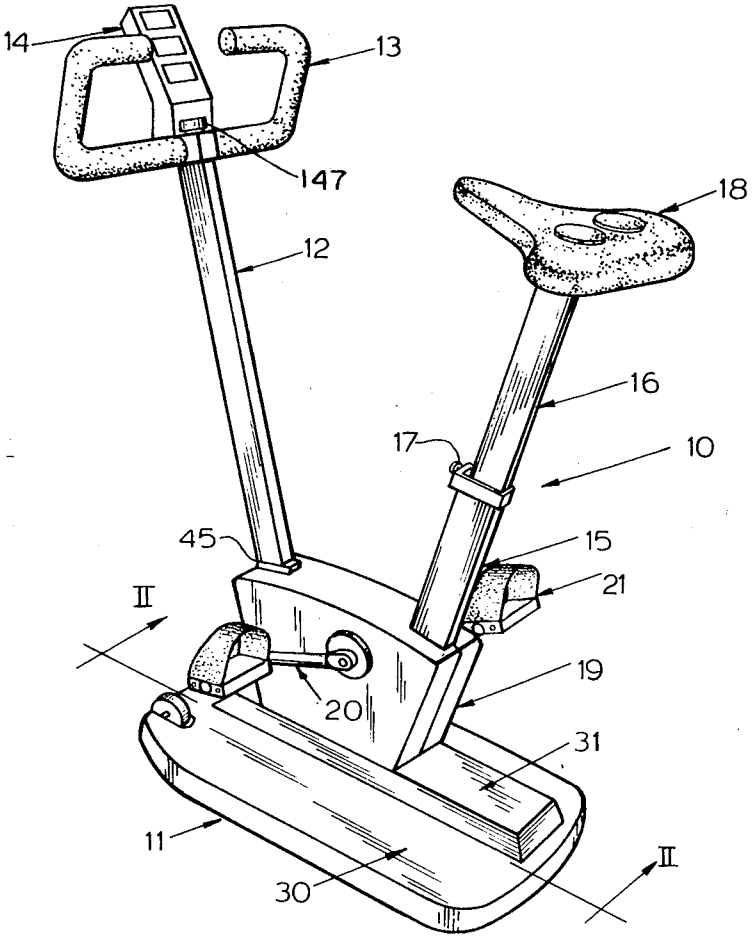
FIG. 1 is an isometric view of an exercise device made in accordance with the principles of the present invention.

Turning now to the details of the improved resistence freewheel mechanism in accordance with this invention, initial reference is made to FIG. 1, illustrative of a typical operational environment. As there shown, a compact ergometric exerciser of the type employing a horizontal flywheel is generally indicated by a reference numeral 10. Exerciser 10 includes a ground engaging base pedestal assembly 11, fitted with an angularly upwardly extending handle bar mast 12 for mounting horizontal handle bars 13 thereon along with instrument indicators 14. A similar seat mast 15 extends angularly upwardly from pedestal assembly 11, rearwardly of mast 12, for coaxial reception of a seat post 16, adjustably connected and positioned vertically on mast 15 by operation of engaging pin means 17. A typical saddle or seat 18 is mounted on the upper end of post 16. A housing portion 19 of the pedestal assembly encloses a drive shaft and transmission means for rotatably driving a horizontal flywheel in response to actuation of crank arms 20 having foot engageable pedal means 21 thereon, as will be detailed hereinafter.

Figure 2:
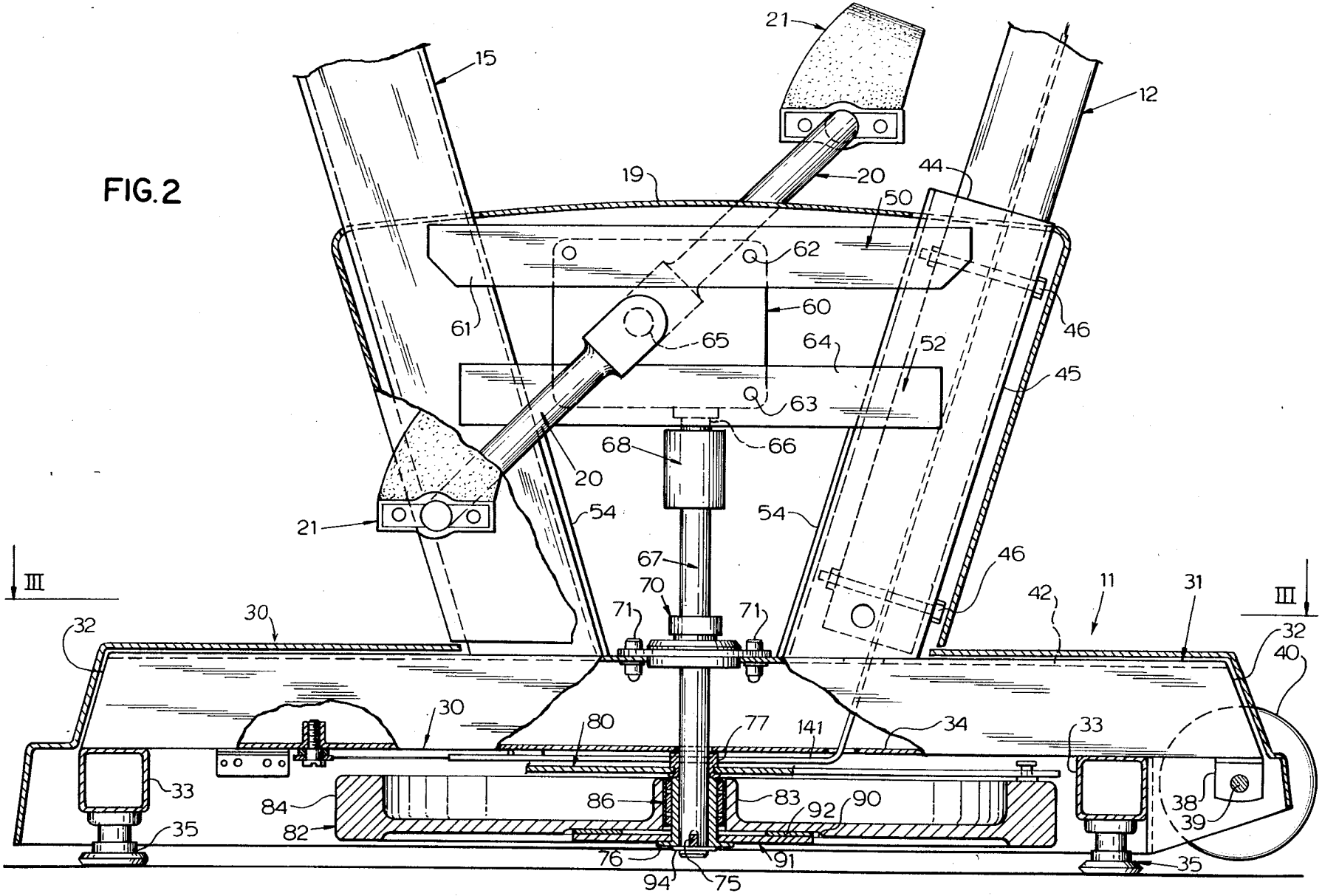
FIG. 2 is a section taken on line II—II of FIG. 1.
Figure 3:
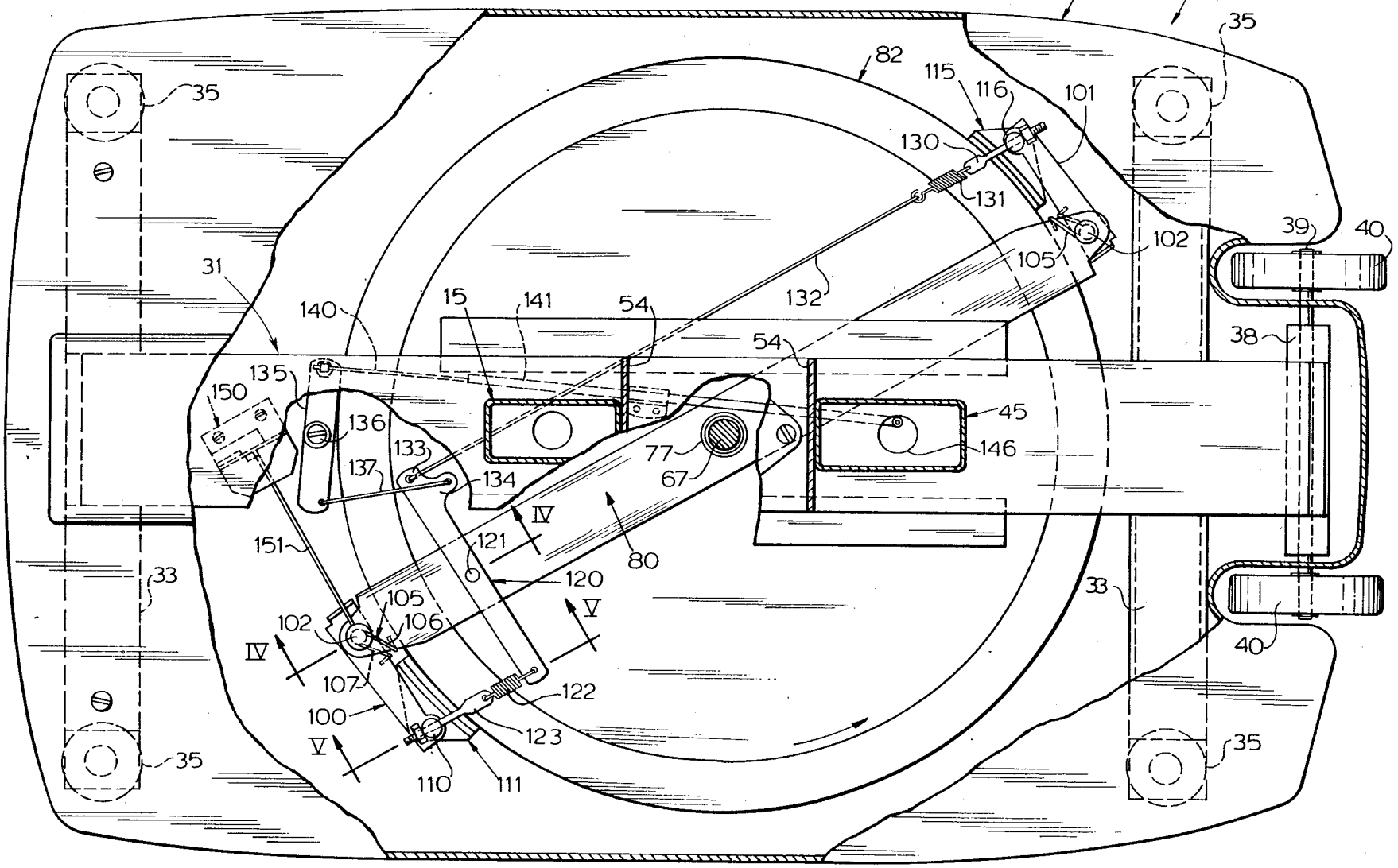
FIG. 3 is a section taken on line III—III of FIG. 2.

Turning now to FIGS. 2 and 3 of the drawings, the features of the improved resistance freewheel mechanism in accordance with this invention will be more fully understood. As shown in these figures the pedestal assembly 11 comprises a base cover 30 of generally rectangular plan configuration and the upper shroud or cover portion 19 which extends about the handle bar and seat masts 12 and 15, respectively, and merges with the base cover 30 to enclose the operating mechanisms of the exerciser assembly 10.

Mounted within and covered by the cover portion 19 and the base cover 30 is a support frame comprising a centrally disposed elongated chassis frame member 31 constituting a closed walled tubular member of generally rectangular cross sectional configuration having angularly downwardly inclined end portions 32—32. The chassis 31 is fitted with a pair of transversely extending tubular stabilizer bars 33—33 adjacent opposite ends thereof which are welded securely to the bottom wall 34 of member 31; such stabilizer bars having adjustable ground engaging feet 35 adjacent their outer ends for supporting the exerciser 10 on an under supporting surface (see FIG. 2).

Mounted across one outer end of the chassis member 31 is a transversly related axle support member 38 journaling an axle member 39 for supporting a pair of laterally spaced wheels 40—40 adjacent its opposite ends; bracket 38 being welded securely to the bottom wall 34 of the chassis member 31. The wheels 40 provide a convenient means for engaging the support surface whereby to transport the exerciser by tilting the same forwardly onto the wheels 40 and pulling or pushing the device across the floor or the like.

Welded to the upper wall 42 of the chassis member 31 are the seat masts 15 and a short tubular member 44 of rectangular cross section which is receptive of the lower end of the handlebar mast 12; the latter being bolted to one wall 45 of the tubular member 44 by bolt means 46—46.

It will be noted that both the tubular member 44 and the seat mast 15 extend angularly upwardly from the upper wall 42 of the chassis member 31 in diverging angular relationship and that such members are rigidly interconnected by an intervening upper bracket member 50 and a parallel spaced lower bracket member 52; both of which bracket members are formed of U-shape cross-section having their base walls suitably cut away to receive the rectangular configuration of the mast member 15 and the tubular member 44 to which bracket member 52 is welded. Generally trapezoidal shaped gusset plates 54—54 are welded to the mast 15 and tubular member 44 beneath the lower bracket member 52 and also to the upper wall 42 of chassis member 31 for laterally stabilizing the mast member 15 and tubular member 44. With this arrangement a sturdy framework for supporting the mechanical working elements of the exerciser is provided, the features of which will now be set forth.

As noted heretofore, the two bracket members 50 and 52 are substantially U-shape in cross section with the open side of bracket 52 facing upwardly and the open side of bracket 50 facing downwardly in assembly with the members 15 and 44. Thus, the bottom or base wall of bracket 52 provides an undersupporting platform for a reduction gear transmission means 60, as best shown in FIG. 2 of the drawings. In a similar fashion the upper bracket 50 extends over the upper end of the transmission means 60 with the downward extending lateral walls on arms 61 thereof extending along opposite sides of the transmission casing for reception of machine bolts or similar fasteners indicated at 62. Corresponding connection by bolt means 63, is carried out between the transmission housing and the upwardly extending side walls 64 of the lower bracket 52.

A horizontally disposed input shaft 65 extends outwardly of opposite sides of the transmission means 60 for connection with oppositely posed crank arms 20 in accordance with conventional practice. The transmission means 60 may have a gear ratio of substantially 5:1 for rotatably driving a vertically disposed output shaft 66 coaxially connected with a vertical drive shaft 67 by means of an intervening coupling 68 which is suitably keyed and pinned to the shafts 66 and 67. The lower end of drive shaft 67 passes through the upper wall 42 of the chassis member 31 via a suitable central opening formed therethrough. Rotational support of shaft 67 is provided by a bearing assembly 70 fastened to the platform wall 42, as by bolt means 71. Shaft 67 passes downwardly through the chassis member 31 and is suitably slotted at its lower end for reception for a transverse key member 75 which extends across the shaft member 67 and serves to interconnect such shaft with a hardened bushing sleeve 76 slip fit over the lower end of shaft 67. Sleeve 76 is disposed coaxially beneath a second bearing means 77 receptive of shaft 67 and mounted in a suitable opening therefor formed centrally of an elongated brake arm 80 which extends diametrically across the upper side of a cast metal flywheel 82 formed with a central hub portion 83 and a concentrically related circumferential wall or face 84 at its outer periphery.

Hub 83 of the flywheel is fitted internally with a clutch bearing assembly 86 pressed into a central cylindrical bore of the hub. The sleeve member 76 in turn is fitted into the interior of the clutch bearing assembly 86. Clutch assembly 86 is a one way clutch that operates such that roller members therein lock up between the frictionally engaged exterior of sleeve 76 and the outer bearing cage of the clutch when the drive shaft 67 is rotated in one direction in response to pedaling action of the crank arms 20. Conversely reversing the direction or rotation of the shaft 67 effectively releases the roller members of the clutch assembly permitting the flywheel 82 to freewheel or rotate about the shaft 67. Thus it will be recognized that positive driving of the flywheel 82 takes place in response to rotation of shaft means 67 in one direction and release of the flywheel takes place in response to reverse rotational movement of the drive shaft relative to the clutch assembly and flywheel. Suitable clutch bearing assemblies for this purpose are commercially available from the Torrington Company, Torrington, Conn.

Mounted beneath the bearing clutch assembly 86 and immediately below an inset area 90 formed in the lower face of the flywheel, is a second clutch means comprising clutch plate 91 having a annular friction clutch shoe 92 mounted on the upper face thereof for frictionally engaging the inset area 90 of the flywheel. The clutch plate 91 is fixed by the key means 75 to the drive shaft 67 for rotation therewith and a snap ring 94 is engaged in a kerf formed about the circumference of shaft 67 to axially hold the bushing sleeve 76, key 75, clutch plate 91 and flywheel 82 on shaft 67.

It will be appreciated that inasmuch as the flywheel 82 is free to move axially with the bushing sleeve 76 along shaft 67, the weight of the flywheel bears against the frictional clutch shoe 92 to regulate frictional engagement of the second clutch means with the flywheel. In the normal order of operation with the bearing clutch means 86 locked up, rotation of drive shaft 67 in a driving direction effects conjoint rotation of the flywheel 82 and friction clutch means 91. However, in the instance where reverse torque is applied to the drive shaft 67 to disengage the bearing clutch means 86, frictional slippage of the second clutch means 91 will take place to release the flywheel for freewheeling when the relative torque differential between the friction clutch pad 92 and the rotating flywheel 82 exceeds a predetermined value, determined by the weight of the flywheel and its frictional engagement with pad 92 in the illustrated case.

Compression spring means (not shown) also may be mounted between the flanged end of the sleeve member 76 and the underside of the friction clutch plate 91 to provide a regulatable means for adjusting clutch contacting pressure and thus the torque differential required to effect slippage between the flywheel and friction clutch means in accordance with known practice. This latter arrangement is particularly desirable in the event the flywheel is disposed vertically for rotation about a horizontal axis as opposed to the horizontally moveable flywheel illustrated which depends on the gravitational weight of the flywheel to effect the frictional engagement of clutch means 91.

Figure 5:
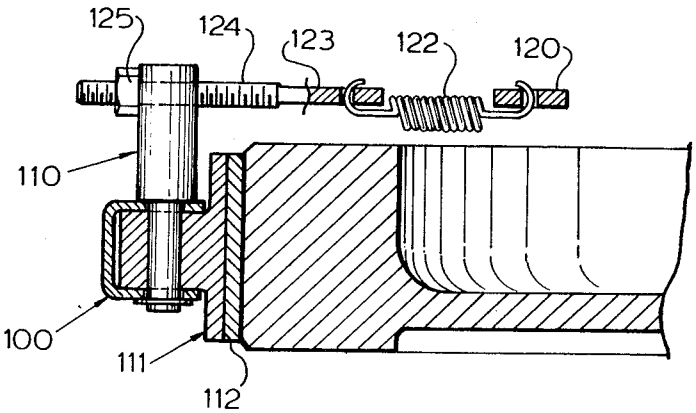
FIG. 5 is section taken on line V—V of FIG. 3.
Figure 4:
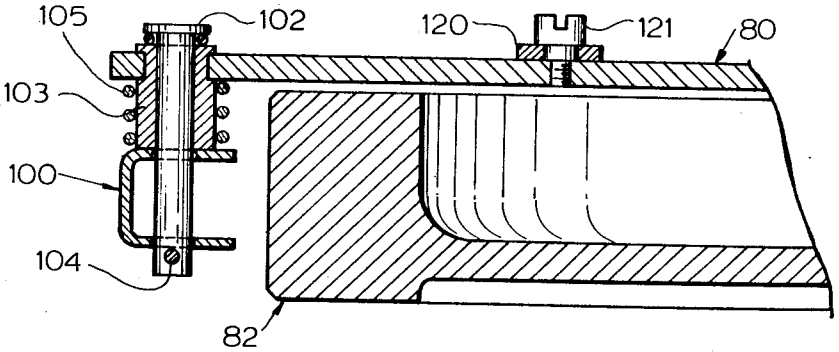
FIG. 4 is a section taken on line IV—IV of FIG. 3.

In addition to the frictional clutch means 91 which imposes frictional drag on the free rotational movement of the flywheel and which may be overcome by relative rotation between the drive shaft 67 and flywheel to provide a predetermined torque differential therebetween, as above noted, exerciser 10 is also provided with brake means for varying the amount of force necessary to drive the flywheel. This provides a regulatable load against which the user/operator of the exerciser may work. Such brake means, as best illustrated in FIGS. 2 and 3 of the drawings and detailed in cross-sections 4 and 5, comprises the elongated brake arm 80 mounted centrally on the bearing means 77 for free movement thereabout and relative to the drive shaft 67. The brake arm 80 extends diametrically across and beyond the outer periphery of the flywheel 82. A pair of brake levers 100 and 101 of generally U-shaped cross section, as illustrated in FIGS. 4 and 5 of the drawings, are pivotally attached to the opposite outer ends of the brake arm 80 by pin means 102. Bushing bearings 103, 103 mounted in openings formed for that purpose adjacent the outer ends of the brake arm 80, receive the pins 102 and brake levers 100 and 101 are held beneath such bushings by pin means 104 which extend through pins 102 beneath levers 100 and 101. A generally U-shaped spring means 105 having one or more central turns therein is mounted about each bushing bearing 103. Extending arms 106, 107 of the springs 105 extend outwardly to respectively engage the brake arm 80 and the adjacent brake lever 100 or 101. The springs 105 serve to bias the two levers 100 and 101 clockwise away from opposite ends of the brake arm 80.

A pivot post 110 is mounted at the outer end of brake lever 100, extending through such lever to pivotally join a brake shoe 111 to lever 100. Shoe 111 carries a pad 112 for engaging the peripheral face 84 of the flywheel as illustrated in FIG. 5 of the drawings. In a similar fashion the lever arm 101 carries brake shoe 115 on a pivot post 116 for engaging the opposite side of the flywheel.

Inasmuch as the two spring members 105 bias the lever arms 100 and 101 away from the periphery of the flywheel as illustrated, means are provided for moving such shoes against the flywheel; such means comprising a yoke lever 120 pivotally mounted on a central pivot 121 generally to extend across one end of the brake arm 80 (see FIG. 4). One end of yoke 120 is joined to brake lever 100 by means of a brake spring 122 and a connector link 123 having a threaded shank portion 124 that passes through the pivot post 110 and is adjustably positioned thereon by fastening nut means 125 (see FIG. 5). Adjusting nut means 125 serves to regulate initial engagement between the brake pad 112 and the periphery of the flywheel. In a similar manner the brake lever 101 is connected to the opposite outer end of the yoke lever 120 by means of adjustable link member 130, brake spring 131 and an extending wire connector 132; the latter being pivotally joined to the end 133 of the yoke lever 120. Link 130, like link 123, is equipped with an adjustment nut which serves to adjustably regulate the initial engagement between the pad on brake shoe means 115 and the periphery of the flywheel.

In order to provide the operator with control means for changing contacting pressure of the brake shoes with the flywheel, a projecting ear 134 formed on the pivotally mounted yoke lever 120 is cross connected with a shorter yoke arm 135 pivotally fastened by pivot screw means 136 to the lower side of the chassis member 31 by means of a wire link 137 which extends between ear portion 134 and one end of the arm 135. The opposite end of the yoke arm 135 is connected to a control wire or cable means 140, protected by a covering sheath 141, which extends upwardly through opening 146 in chassis wall 42 into the interior of the handle bar mast 12. The upper end of cable means 140 is connected to a manually operable control knob 147 on mast 12. The user/operator thus may regulate or adjust the brake pressure applied to the periphery of the flywheel by appropriately turning the control to tension or slack the control cable 140 and accordingly move the yoke arm 135 to pivot yoke lever 120 and correspondingly move the brake shoes 111 and 115 toward or away from the periphery of the flywheel as the case may be.

In order for the user/operator to have a measurement of the amount of power he is dissipating at the flywheel, transducer means 150 is mounted on the chassis member 31 and interconnected with the brake arm 80 by means of an intereaching wire link 151. Thus the transducer responds to the force on the brake arm 80 in accordance with the braking engagement and drag of the shoes 111 and 115 on the moving flywheel. The transducer output and flywheel speed is suitably coupled to the instrument means 14 to provide a visual indication to the user operator of the work load, in accordance with known practice in this art.

USE IN OPERATION

The above described dual action clutch arrangement of this invention permits the user/operator of the exerciser to selectively effect freewheeling of the flywheel by reversing or stopping pedaling activity which releases the positive acting clutch from the drive shaft. Providing the torque differential between the rotating flywheel and the second friction clutch means is sufficient to overcome the latter's frictional lock-up with the flywheel, free rotational movement of the flywheel or freewheeling except for the brake drag will ensue. If the operator, however, merely slows his pedaling activity so that the drive shaft rotates slower than the flywheel the positive acting clutch will be released but the friction clutch means may not, depending on the torque differential between the flywheel and the friction clutch means. If that differential is insufficient to release the friction clutch, the frictional drag between the flywheel and the friction clutch will drive the crank arms and pedals with the flywheel. This activity, however, can be interrupted and or controlled to the operator's choosing by further slowing or stopping the pedaling action to overcome the frictional drag of the friction clutch means. By merely slipping the frictional clutch at the desired level, the rotating flywheel will assist in the pumping activity of the operator by slowly rotating the drive shaft via the friction clutch means. Conversely, when it is desired to resume pedaling activity in order to positively drive the flywheel, the friction clutch provides an intial resistance to crank arm movements as the drive shaft is brought up to the rotational speed of the flywheel. Thus, the friction clutch means provides a gradual semi-resistant action for reengaging the positive acting first clutch means and flywheel with the drive shaft.

From the foregoing it is believed that those familiar with the art will readily recognize and appreciate the novel advancement presented by the present invention and while the same has been hereinabove described in association with the preferred embodiment illustrated in the accompanying drawings, the same is susceptible to variation, modification and substitution of equivalents without departing from the spirit and scope of this invention which is intended to be unlimited by the foregoing description except as may appear in the following appended claims.

I claim:

1. In an ergometric exerciser, a resistance freewheel mechanism comprising: drive shaft means, means for rotatably driving said shaft means, a flywheel rotatably mounted on said shaft means, first positive acting clutch means coupled to said shaft means and operable in response to rotation of said shaft means in one direction to positively interlock said flywheel and shaft means for conjoint rotation in said one direction, rotation of said flywheel in said one direction at a relative speed greater than said shaft means causing said first clutch means to release said flywheel for rotation relative to said shaft means, and second clutch means positively coupled to said shaft means and frictionally coupled to said flywheel, said second clutch means being operable, upon releasing operation of said first clutch means, to restrict rotation of said flywheel relative to said shaft means until the torque differential between said flywheel and second clutch means exceeds a predetermined torque value sufficient to overcome the frictional coupling between said second clutch means and flywheel whereupon said flywheel is released for freewheeling movement about said shaft means.

2. The combination of claim 1 wherein said second clutch means comprises means frictionally engaging a non-peripheral face of said flywheel.

3. The combination of claim 1 wherein said second clutch means provides selected resistance to the rotation of said flywheel upon releasing operation of said first clutch means.

4. The combination of claim 1 wherein said first clutch means comprises a roller bearing clutch assembly having positive connection with the hub of said flywheel and a bushing member disposed concentrically about said shaft means, and means positively interlocking said bushing member, said shaft means and second clutch means.

5. The combination of claim 4 and means axially interlocking said bushing member and second clutch means with said shaft means.

6. The combination of claim 1 wherein said flywheel gravitationally engages said second clutch means to effect interlock therebetween.

7. The combination of claim 1 wherein said drive shaft means is vertically oriented, and said flywheel rotates in a horizontal plane.

8. The combination of claim 1 wherein said drive means comprises a transmission means driven by foot pedal operated crank arms.

9. The combination of claim 1, and adjustable brake means operably engaged with the periphery of said flywheel and providing a selectively adjustable load for resisting rotation of said flywheel.

* * * * *